US005878871A

United States Patent [19]

Miesner

[11] Patent Number: 5,878,871

[45] Date of Patent: Mar. 9, 1999

[54] STRAP WITH BREAKAWAY CONNECTOR FOR EXTENDING PULL CHAINS ON SWITCHES

[76] Inventor: Fred A. Miesner, 219 W. Main St., Sedalia, Mo. 65301

[21] Appl. No.: 911,491

[22] Filed: Aug. 14, 1997

[51] Int. Cl.[6] ..... H01H 3/20

[52] U.S. Cl. ..... 200/331; 200/330

[58] Field of Search ..... 200/331, 330, 200/329, 543, 544, 545, 546, 537; 24/602, 115 F, DIG. 22

[56] References Cited

U.S. PATENT DOCUMENTS

| | | | |
|---|---|---|---|
| D. 334,563 | 4/1993 | Burbage | D13/173 |
| D. 351,324 | 10/1994 | Nepal | D8/14 |
| 1,175,838 | 3/1916 | Sutter | 200/331 |
| 1,721,222 | 7/1929 | Kaminsky | 200/331 |
| 3,827,039 | 7/1974 | Agnese | 200/331 |
| 4,339,061 | 7/1982 | Dunn | 224/901.2 |
| 4,567,337 | 1/1986 | Woods, I et al. | 200/331 |
| 5,055,645 | 10/1991 | Hull et al. | 200/331 |
| 5,533,238 | 7/1996 | Say | 24/115 |
| 5,548,875 | 8/1996 | Hert et al. | 24/265 |

FOREIGN PATENT DOCUMENTS

| | | | |
|---|---|---|---|
| 40 35 629 C | 12/1991 | Germany | 200/331 |

*Primary Examiner*—David J. Walczak
*Attorney, Agent, or Firm*—Richard J. Grundstrom

[57] ABSTRACT

A strap that incorporates a breakaway connector that extends between a chain on a switch contained on a fixture and a bedpost or other fixed or stationary object. The strap has an attachment mean, such as hook and loop fastener, on a lower end for making a loop to attach the strap to the object. The upper end has a breakaway connector with a chain attaching device attached. The chain attaching device attaches the strap with the breakaway connector to the chain on a switch on a fixture. The breakaway connector disconnects the strap from the switch if the strap is pulled to hard, yanked or jerked. The breakaway connector disconnects to protect the switch from breaking. The connector is easily reconnected once disconnected. A shock absorber is also provided for additional protection and to prevent unnecessary disconnects during momentary pulls near or slightly over the disconnect tension.

11 Claims, 2 Drawing Sheets

STRAP WITH BREAKAWAY CONNECTOR FOR EXTENDING PULL CHAINS ON SWITCHES

BACKGROUND OF THE INVENTION

The present invention relates to a strap with a breakaway connector for extending a pull on switches and more particularly to a pull strap that has a breakaway connector that attaches to and extends a pull chain on pull chain switch for an electric fixture that protects the switch from breakage due to hard pulls, yanks or jerks.

There are a number of different light fixtures, fans and other devices that have a pull chain switch for turning the light, fan or other type device off and on. On ceiling fans a chain is also used for changing the fans' speed and on some fans the direction of rotation. These chains are often positioned at a height that requires an extension, otherwise the pull would be to high for most people to reach. There are many different straps, cords and chains that are designed to extend the length. Some of these extensions are just basic chains, cords or straps while others are fancifully designed.

A typical problem encountered when entering a dark room is finding the pull to turn the light on. People entering a room typically sweep an arm back and forth until the pull is encountered. In order to alleviate this problem, the end of an extension has been tied to hooks, bed posts and other convenient items in order to find the pull more easily. It is also a problem for light fixtures located near a bed. The extension is often tied to the bedpost so the light can be turned off and on while in bed.

One of the must prevalent problems with pull switches on light fixtures, fans and other devices is that the switch often breaks when the pull chain is pulled too hard or yanked. This requires the fixture or switch to be replaced. In places such as hospitals, nursing homes, factories and other places where numerous fixtures are used, this problem can be and is very costly. Persons not having full physical or mental capacity or are upset for one reason or another may not realize their own strength when pulling the extension or chain. Whatever the reason, the pull switch is often broke because of a hard pull, jerk or yank on the pull chain or extension thereon.

The strap of this invention overcomes all of the forementioned problems. The strap of this invention is an extension that allows a person to easily reach the pull. Provisions are made for attaching the end of the strap to a convenient located item in order to more easily find the strap. A breakaway connector is incorporated to prevent the pull switch from breaking if pulled to hard, jerked or yanked.

Accordingly, it is an object of the present invention to provide a strap with breakaway connector for extending pull on switches that extends the length of a chain on a pull switch located on a light fixture, fan or any other device or fixture having a pull chain type switch.

Another object of the present invention is to provide a strap with breakaway connector for extending pull on switches that is constructed such that the breakaway connector will disconnect the strap before the switch is broke when pulled to hard or yanked. The breakaway connector provides this protection by disconnecting the extension from the pull but also allows easy reconnection once disconnected.

A further object of the present invention is to provide a strap with breakaway connector for extending pull on switches that provides for attachment to an object or other item such that the strap can be easily found.

SUMMURY OF THE INVENTION

To accomplish the foregoing and other objects of this invention there is provided a strap with breakaway connector for extending pull on switches and more particularly to a strap that connects to a chain pull type switch, located on lights, fans and other fixtures and devices, having a breakaway connector to prevent the switch from breaking if the chain is pulled to hard.

The strap with breakaway connector for extending pull on switches of this invention includes a strap that extends between a chain on a switch contained on a light fixture and a fixed object such as a hook or bed post. The strap has hook and loop fasteners on one end for looping around and attaching to the fixed object. The upper end of the strap has a breakaway connector with a chain attaching device attached thereto. The chain attaching device attaches the strap with breakaway connector for extending pull on switches to the pull chain on the switch for the fixture. If the strap is pulled to hard or jerked the breakaway connector disconnects the strap from the pull to protect the switch from breaking. The connector is easily reconnected once disconnected.

The forementioned and other objects and features of the present invention will be better understood and appreciated from the following detailed description of the main embodiment thereof, selected for purposes of illustration and shown in the accompanying drawings.

BRIEF DESRIPTION OF THE DRAWINGS

FIG. 1 is a front view showing the strap with breakaway connector for extending pull chains on switches.

FIG. 2 a side view showing the upper portion of the strap with breakaway connector for extending pull chains on switches.

DETAILED DESCRIPTION

Figure 1:
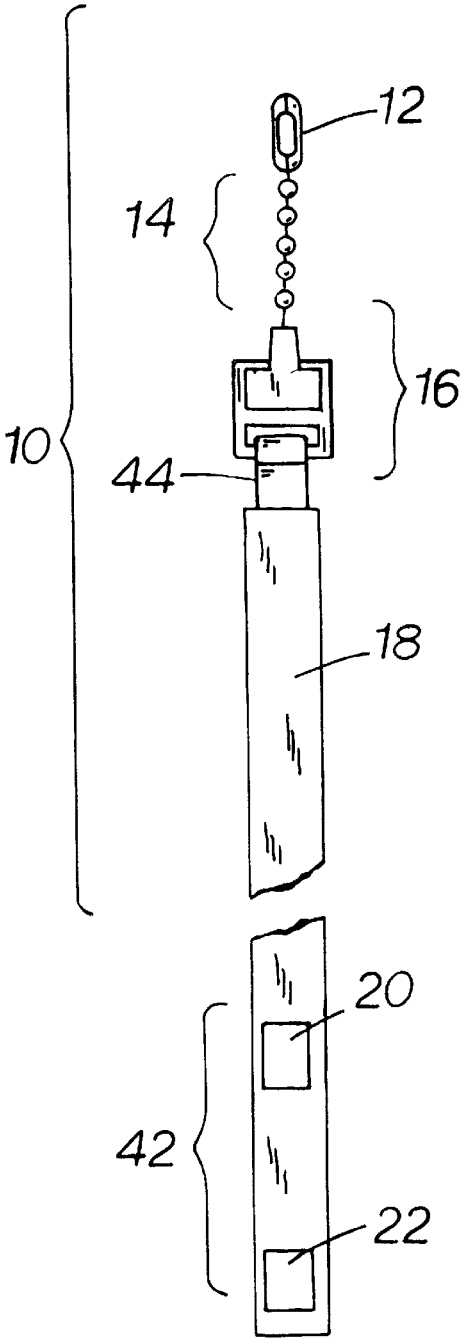

Referring now to the drawings in general there is shown the preferred embodiment for the strap with breakaway connector for extending pull on switches.

Basically the strap with breakaway connector for extending pull on switches 10, in the preferred embodiment, has a chain connecting device 12, a breakaway connector 16, an elongated strap 18 extending from the breakaway connector 16 and an attachment means 42 for attaching the lower end of the elongated strap 18 to a fixed or stationary item 24.

The preferred embodiment and the best mode contemplated of the strap with breakaway connector for extending pull on switches 10 of the present invention are herein described. However, it should be understood that the best mode for carrying out the invention hereinafter described is offered by way of illustration and not by the way of limitation. It is intended that the scope of the invention include all modifications which incorporate its principal design features.

The chain connecting device 12, in the preferred embodiment, is typical in the art. Generally, the chain connecting device 12 is a cylindrical shaped connector with an opening on each end and a lateral opening on the side thereof. A slot extends from the end openings to the lateral opening on the side. The bottom ball link of the chain 26 extending from switch 28 on fixture 30 is inserted in the lateral opening and pulled upward into the chain connecting device 12. The wire link joining the ball link is pulled through the slot until the ball link is situated inside the chain connecting device 12 and under the end opening of the chain connecting device 12.

The above described chain connecting device 12 is the principle connector used in most applications. However, it should be understood that other connectors 12 could be used depending on the particular type of "chain" 26 extending from switch 28. This invention does not depend on the particular type of chain connecting device 12 incorporated, but rather in generic form incorporating any type connecting device 12 needed for the particular application.

An extension 14 is generally provided to provide ease of connecting and handling. It has been demonstrated that the extension 14 allows greater flexibility and ease of handling the strap with breakaway connector for extending pull chains on switches 10 when attaching to chain 26. Generally, the extension can be fairly short, but any length could be used depending on the application.

In the preferred embodiment the extension 14 is a short chain similar to the chain 26 on switch 28. This allows for easy connection to chain connecting device 12. The extension 14, in addition to allowing flexibility and ease of installation, attaches the chain connecting device 12 to the breakaway connector 16.

The breakaway connector 16 is one of the key components to this invention. It provides the protection to switch 28 due to hard pulls, yank or jerks. Therefore, the breakaway connector 16 must have the ability to disconnect the strap 18 from the switch 28 with a given tension. The breakaway connector 16 must also have the ability to be easily reconnected once disconnected, and to withstand numerous pulls and many disconnects and reconnections without breakage. With these considerations the preferred embodiment is herein described. However, it should be noted other deviations, modification and substitution, now or later known, could be used without departing from the scope and spirit of this invention.

In the preferred embodiment, the breakaway connector 16 consists of three components. One of which is a top portion 32 and the remaining two are referred to as bottom portion 34. The bottom portion 34 consist of a pair of tabs 36. The top portion 32 is a plastic inverted U shape clip. Inward facing barbs 38 are located on the inside end of each leg of the U shaped clip or top portion 32. The top of top portion 32 is attached to the extension 14 or directly to the chain connecting device 12, depending on the particular configuration.

Figure 2:
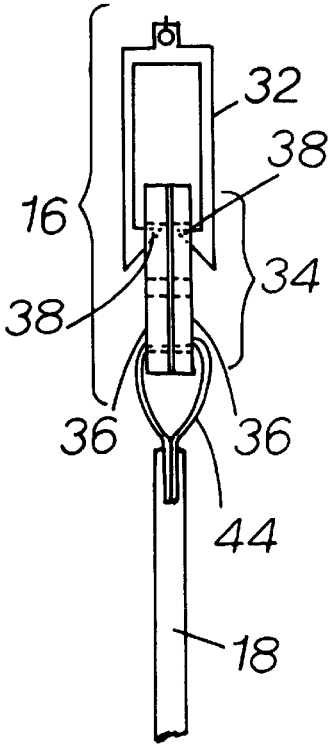
Figure 3:
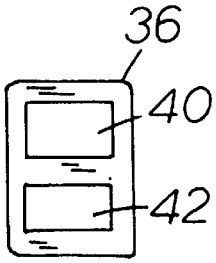
FIG. 3 is a front view showing the preferred embodiment of the tab used in the strap with breakaway connector for extending pull chains on switches.

The bottom portion 34 is a pair of tabs 36. The tabs 36 are generally mirror images of each other. Each of the tabs 38 will have at least one opening 40. In the preferred embodiment as shown in FIG. 3, there are two openings 40 and 42. One opening 40 could be used and would work just as well. However, the center bar separating the openings 40 and 42 provides additional strength to the tabs 36 and is therefore the considered the preferred embodiment. The tabs 36 are inserted together as a pair between the legs of the U shaped top portion 32, as shown in FIG. 2. The barbs 38 on the inside of said U shaped top portion 32 engage the opening on the tab 36 when inserted. This arrangement provides tension and holds the tabs 36 in place within the U shaped top portion 32. The elongated strap 18 is attached to a lower portion of the opening 40 or in the embodiment as shown on the bottom of opening 42. The legs on the U shaped top potion 32 spread to allow the tabs 36 to be inserted. The legs also spread when there is a hard pull, jerk or yank. This allows the tabs 36 or bottom portion 34 to be released from the top portion 32. This arrangement provides the necessary protection for switch 28 if the elongated strap 18 is pulled to hard, yanked or jerked.

A single tab 36 could possibly be used with the proper design. However, testing has demonstrated that the pair of tabs 36 provide the better protection. The pair of tabs 36 disconnects easier than a single tab and the pair does not break as easily as the single tab. It is somewhat more difficult to insert the pair of tabs 36 in the upper portion 34 but the advantages of durability and ease of disconnect outweigh the use of a single tab.

The elongated strap 16 is typically made of flexible vinyl, cotton, or other type of flexible durable material. In a most basic form, the elongated strap 18 is made of a vinyl material folded over itself and sewn together. This arrangement resembles a bias tape with the outer edge sewn together. Other arrangements and material could also be substituted without departing from the scope and spirit of the invention.

The elongated strap generally extends from the breakaway connector 16 and hangs downward. The lower end may be attached to some fixed item 24, such as a bedpost, wall hook or some other fixed or stationary object for convenience in finding the elongated strap 18.

A shock absorber 44 may also be incorporated between the elongated strap 18 and the breakaway connector 16. This is an optional feature which is not necessarily vital to the protection of the switch. It provides extra cushion and absorbs shock from sudden jerks or yanks and prevents unnecessary disconnects of the breakaway connector 16 when a momentary pull or yank is slightly beyond or at the disconnect tension.

In the preferred embodiment, the shock absorber 44 is made of elastic. The elastic would be a strip of elastic folded through and over the bottom potion of opening 40 or 42 with the lower ends of the elastic strip joined. The joined ends are then attached to the upper end of the elongated strap 18. It has been demonstrated that elastic strips provide the necessary shock absorbing characteristics and durability necessary for this function. Other material could be substituted.

The thickness of joined end of the elastic strip or shock absorber 40 is smaller than the thickness of the elongated strap 18. Therefore, the use of a shock absorber 40 as such makes attachment of the elongated strip 18 to the breakaway connector 16 somewhat easier.

Figure 4:
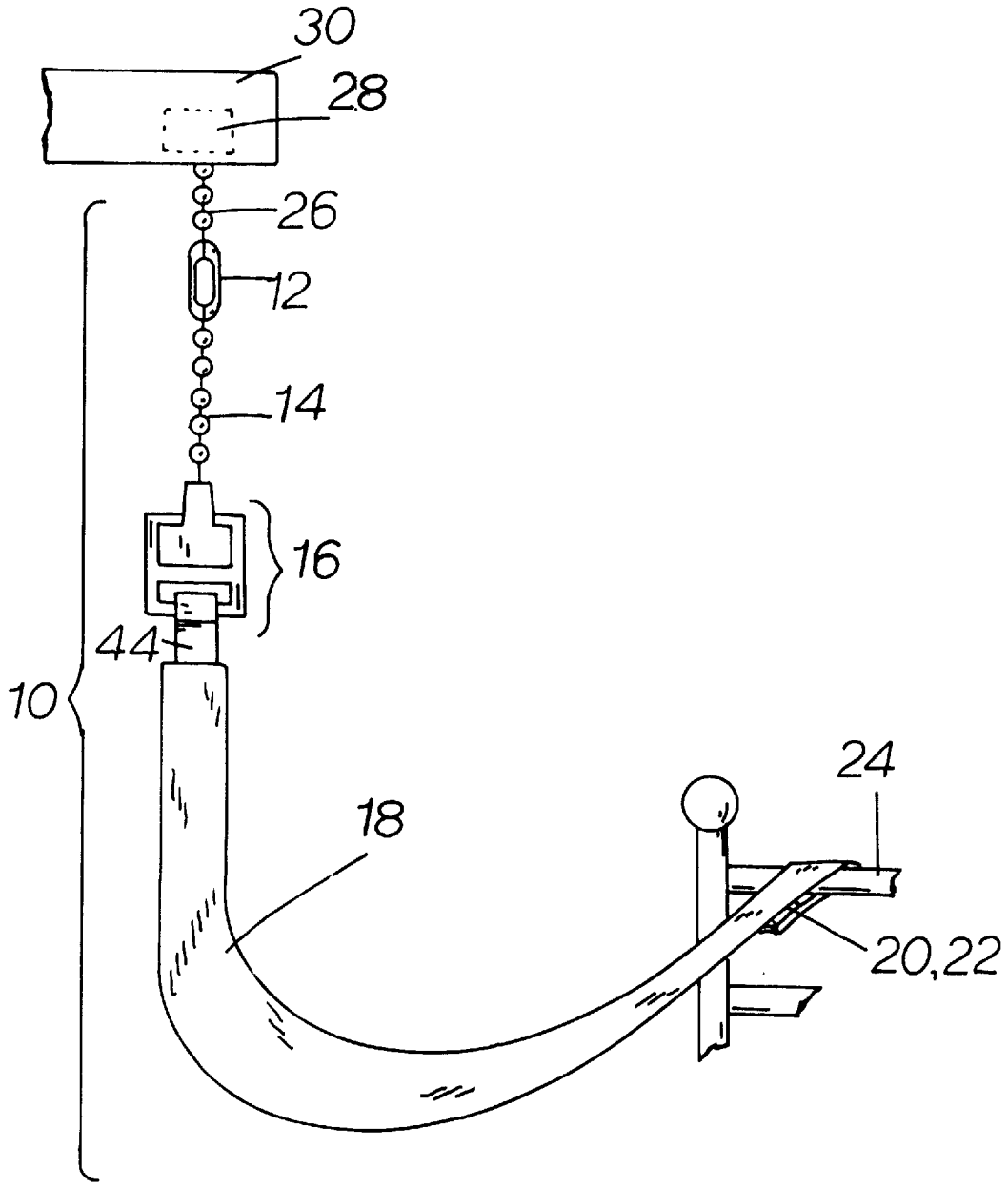
FIG. 4 is a view showing a typical application of the strap with breakaway connector for extending pull chains on switches.

An attachment means 42 is incorporated at the lower end of the elongated strap 18 to provide a means of attaching the lower end of elongated 18 to a fixed or stationary object 24. The fixed object 24 could be a bedpost as illustrated in FIG. 4 or any other fixed or stationary object conveniently located. In the preferred embodiment, the attachment means 42 consists of hoop and loop fasteners 20 and 22. The hook and loop fasteners 20 and 22 are attached to a lower end of the elongated strap in a spaced apart relationship and allows a loop at the end to the elongated strap 18 to be made. The loop can be wrapped around the fixed object 24 to attach the lower end of the elongated strap 18 to the fixed or stationary item.

Other types of attachment means could also be used. Button with button hole, snaps, or any other type of fastener or similar device could also be used without departing from the inventive concepts herein disclosed.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the following claims and their equivalents.

What is claimed is:

1. A strap with breakaway connector for extending pull on switches comprising:

a chain connecting device for attaching said strap with breakaway connector for extending pull on switches to a chain pull on a switch for a fixture;

a breakaway connector having a top portion and bottom portion, said top portion of said breakaway connector attached to a lower end of said chain connecting device, and said lower portion attachable to and disconnectable from said top portion; said top portion being an inverted U shaped clip and said bottom portion being a pair of tabs insertable and in removable engagement within said U shaped clip;

an elongated strap extending from said bottom portion of said breakaway connector, said breakaway connector disconnecting said elongated strap from said chain connecting device if said elongated strap is pulled too hard; and an attachment means attached to a lower end of said elongated strap, said attachment means providing a means to attach a lower end of said elongated strap to a fixed or stationary item.

2. The strap with breakaway connector for extending pull on switches as set forth in claim 1 further claiming an extension between said chain connecting device and top portion of said breakaway connector, said extension connecting said chain connecting device to said breakaway connector.

3. The strap with breakaway connector for extending pull on switches as set forth in claim 2 in which said extension comprises a short chain.

4. A strap with breakaway connector for extending pull on switches comprising:

a chain connecting device for attaching said strap with breakaway connector for extending pull on switches to a chain pull on a switch for a fixture;

a breakaway connector having a top portion and bottom portion, said top portion having an inverted U shape with inward facing barbs at the inside end of each leg on said U shaped top portion, said bottom portion being a pair of tabs, each of said tabs having at least one opening, said tabs being inserted together as a pair between said legs of said U shaped top portion, said barbs on the inside of said U shaped top portion engaging said opening on said tabs, said legs spreading to allow said tabs to be inserted and released;

an elongated strap extending from said bottom portion of said breakaway connector, said breakaway connector disconnecting said elongated strap from said chain connecting device if said elongated strap is pulled too hard; and an attachment means attached to a lower end of said elongated strap said attachment means providing a means to attach a lower end of said elongated strap to a fixed or stationary item.

5. The strap with breakaway connector for extending pull on switches as set forth in claim 1 further claiming a shock absorbing means, said shock absorbing means attached between said elongated strap and said breakaway connector.

6. A strap with breakaway connector for extending pull on switches comprising:

a chain connecting device for attaching said strap with breakaway connector for extending pull on switches to a chain pull on a switch for a fixture;

a breakaway connector having a top portion and bottom portion, said top portion of said breakaway connector attached to a lower end of said chain connecting device, and said lower portion attachable to and disconnectable from said top portion;

a shock absorbing means, said shock absorbing means attached to said bottom portion of said breakaway connector, said shock absorbing means comprises an elastic strip;

an elongated strap extending from said shock absorbing means, said breakaway connector disconnecting said elongated strap from said chain connecting device if said elongated strap is pulled too hard; and an attachment means attached to a lower end of said elongated strap, said attachment means providing a means to attach a lower end of said elongated strap to a fixed or stationary item.

7. The strap with breakaway connector for extending pull on switches as set forth in claim 1 in which said attachment means comprises hook and loop fasteners attached to a lower end of said elongated strap in a spaced relationship that allows a loop to be made at the end of said elongated strap for attachment to a fixed or stationary item.

8. A strap with breakaway connector for extending pull on switches comprising:

a chain connecting device for attaching said strap with breakaway connector for extending pull on switches to a chain pull on a switch of a fixture;

an extension extending from a lower end of said chain connecting device;

a breakaway connector, said breakaway connector comprises a top portion attached to a lower end of said extension and a bottom portion, said top portion having an inverted U shape with inward facing barbs at the end of each leg on said U shaped top portion, said bottom portion being a pair of tabs, each of said tabs having at least one opening, said tabs being inserted together as a pair between said legs of said U shaped top portion, said barbs on the inside of said U shaped top portion engaging said opening on said tabs, and said legs spreading to allow said tabs to be inserted and to release said tabs;

an elongated strap attached to and extending from a lower portion of an opening on said tabs, said tabs being disconnected from said inverted U shaped top portion if said elongated strap is pulled to hard; and an attachment means attached to a lower end of said elongated strap, said attachment mean comprising hook and loop fasteners attached in a spaced relation to allow a loop to be made at the end of said elongated strap for providing a means to attach a lower end of said elongated strap to a fixed or stationary item.

9. The strap with breakaway connector for extending pull on switches as set forth in claim 8 in which said extension comprises a short chain.

10. A strap with breakaway connector for extending pull on switches comprising:

a chain connecting device for attaching said strap with breakaway connector for extending pull on switches to a chain pull on a switch of a fixture;

a chain extension extending from a lower end of said chain connecting device;

a breakaway connector, said breakaway connector comprises a top portion attached to a lower end of said chain extension and bottom portion, said top portion having an inverted U shapes with inward facing barbs at the end of each leg on said U shaped top portion, said bottom portion being a pair of tabs, each of said tabs having at least one opening, said tabs being inserted together as a pair between said legs of said U shaped top portion, said barbs on the inside of said U shaped top portion engaging said opening on said tabs, and said legs spreading to allow said tabs to be inserted and to release said tabs;

a shock absorbing means, said shock absorbing means attached to said opening on said tabs of said breakaway connector;

an elongated strap attached to and extending from said shock absorber, said tabs of said breakaway connector being disconnected from said inverted U shaped top portion if said elongated strap is pulled to hard or yanked; and hook and loop fasteners attached to a lower end of said elongated strap in a spaced relationship to allow a loop to be made at the end of said elongated strap for providing a means to attach a lower end of said elongated strap to a fixed or stationary item.

11. The strap with breakaway connector for extending pull on switches as set forth in claim 10 in which said shock absorber comprises an elastic strip folded through said opening on said tabs and connected to an upper end of said elongated strap.

* * * * *